US011805370B2

(12) United States Patent
Monti et al.

(10) Patent No.: US 11,805,370 B2
(45) Date of Patent: Oct. 31, 2023

(54) BALANCED ARMATURE RECEIVER HAVING DIAPHRAGM WITH ELASTOMER SURROUND

(71) Applicant: Knowles Electronics, LLC, Itasca, IL (US)

(72) Inventors: Christopher Monti, Elgin, IL (US); Donald Verghese Jacob, Chicago, IL (US); Matthew Manley, Crystal Lake, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 13 days.

(21) Appl. No.: 17/137,771

(22) Filed: Dec. 30, 2020

(65) Prior Publication Data

US 2022/0210576 A1 Jun. 30, 2022

(51) Int. Cl.

| | |
|---|---|
| ***H04R 11/02*** | (2006.01) |
| ***H04R 7/18*** | (2006.01) |
| ***H04R 1/02*** | (2006.01) |
| ***H04R 7/12*** | (2006.01) |

(52) U.S. Cl.

CPC ..... *H04R 11/02* (2013.01); *H04R 1/025* (2013.01); *H04R 7/12* (2013.01); *H04R 7/18* (2013.01); *H04R 2400/11* (2013.01)

(58) Field of Classification Search

CPC ... H04R 7/00; H04R 7/02; H04R 7/04; H04R 7/06; H04R 7/10; H04R 7/16; H04R 7/18; H04R 7/20; H04R 7/22; H04R 9/06; H04R 2207/00; H04R 2207/021; H04R 2400/11; H04R 11/00; H04R 11/02; H04R 2307/00; H04R 2307/027; H04R 2307/204; H04R 2307/207

See application file for complete search history.

(56) References Cited

U.S. PATENT DOCUMENTS

| | | | |
|---|---|---|---|
| 3,588,383 | A | 6/1971 | Carlson et al. |
| 4,272,654 | A | 6/1981 | Carlson |
| 5,647,013 | A | 7/1997 | Salvage et al. |
| 6,041,131 | A | 3/2000 | Kirchhoefer et al. |
| 5,647,013 | C1 | 5/2001 | Salvage et al. |
| 6,658,134 | B1 | 12/2003 | Hal et al. |
| 7,103,196 | B2 | 9/2006 | Warren |
| 7,203,334 | B2 | 4/2007 | Schafer et al. |
| 7,236,609 | B1 | 6/2007 | Tsangaris et al. |
| 7,302,748 | B2 | 12/2007 | Jiles et al. |
| 7,336,797 | B2 | 2/2008 | Thompson et al. |
| 7,860,264 | B2 | 12/2010 | Jiles et al. |
| 7,995,789 | B2 | 8/2011 | Tsangaris et al. |
| 8,018,049 | B2 | 9/2011 | Minervini |
| 8,624,385 | B1 | 1/2014 | Minervini |

(Continued)

FOREIGN PATENT DOCUMENTS

| | | |
|---|---|---|
| CN | 203840067 U | 9/2014 |
| CN | 203840177 U | 9/2014 |

(Continued)

*Primary Examiner* — Walter F Briney, III

(57) ABSTRACT

A balanced armature receiver including a diaphragm with an elastomer surround is disclosed. The surround is fastened to multiple surfaces of the diaphragm and can be a siloxane-based material. In one implementation, the diaphragm includes a paddle flexibly coupled to a frame and the surround covers a gap between the frame and the paddle.

20 Claims, 11 Drawing Sheets

(56) References Cited

U.S. PATENT DOCUMENTS

| | | | |
|---|---|---|---|
| 8,624,387 | B1 | 1/2014 | Minervini |
| 8,629,552 | B1 | 1/2014 | Minervini |
| 8,704,360 | B1 | 4/2014 | Minervini |
| 8,879,767 | B2 | 11/2014 | Wickstrom |
| 9,006,880 | B1 | 4/2015 | Minervini |
| 9,023,689 | B1 | 5/2015 | Minervini |
| 9,137,605 | B2 | 9/2015 | Manley et al. |
| 9,139,421 | B1 | 9/2015 | Minervini |
| 9,148,731 | B1 | 9/2015 | Minervini |
| 9,485,585 | B2 | 11/2016 | McCratic et al. |
| 9,571,941 | B2 | 2/2017 | Heidenreich et al. |
| 9,781,505 | B2 | 10/2017 | Szczech et al. |
| 10,375,462 | B2 | 8/2019 | Liu et al. |
| 2007/0036378 | A1 | 2/2007 | Saltykov et al. |
| 2007/0201715 | A1 | 8/2007 | Minervini |
| 2013/0156235 | A1 | 6/2013 | Wickstrom |
| 2013/0279732 | A1 | 10/2013 | Sanecki et al. |
| 2013/0284537 | A1 | 10/2013 | LoPresti et al. |
| 2015/0201293 | A1 | 7/2015 | Sanecki et al. |
| 2015/0373456 | A1 | 12/2015 | Dayton et al. |
| 2016/0205463 | A1 | 7/2016 | Szczech et al. |
| 2018/0041838 | A1* | 2/2018 | Chang ..... H04R 31/003 |
| 2019/0069091 | A1* | 2/2019 | Bruins ..... H04R 7/18 |
| 2019/0208326 | A1 | 7/2019 | Scheleski et al. |
| 2019/0342666 | A1 | 11/2019 | Dayton et al. |
| 2019/0377321 | A1 | 12/2019 | Azuma et al. |
| 2019/0387321 | A1* | 12/2019 | Dayton ..... H04R 7/16 |
| 2021/0204056 | A1 | 7/2021 | Bradt et al. |
| 2021/0400366 | A1 | 12/2021 | LoPresti et al. |

FOREIGN PATENT DOCUMENTS

| | | | |
|---|---|---|---|
| CN | 203840180 | U | 9/2014 |
| CN | 203951282 | U | 11/2014 |
| CN | 203951286 | U | 11/2014 |
| CN | 204046390 | U | 12/2014 |
| CN | 204046391 | U | 12/2014 |
| CN | 204291354 | U | 4/2015 |
| CN | 204350282 | U | 5/2015 |
| CN | 204350283 | U | 5/2015 |
| CN | 204350285 | U | 5/2015 |
| CN | 204350286 | U | 5/2015 |
| CN | 205584474 | U | 9/2016 |
| CN | 205595924 | U | 9/2016 |
| CN | 205595999 | U | 9/2016 |
| CN | 205830004 | U | 12/2016 |
| CN | 206879077 | U | 1/2018 |
| CN | 214070149 | U | 8/2021 |
| CN | 214429687 | U | 10/2021 |
| PH | 22021050264 | U1 | 7/2021 |
| PH | 22021050699 | | 3/2022 |
| VN | 29365 | A | 4/2012 |

* cited by examiner

BALANCED ARMATURE RECEIVER HAVING DIAPHRAGM WITH ELASTOMER SURROUND

TECHNICAL FIELD

This disclosure relates generally to balanced armature receivers and more particularly to diaphragms having an elastomer surround for a balanced armature receiver.

BACKGROUND

Balanced armature receivers (also referred to as "acoustic receivers" and "receivers" herein) that convert an electrical input signal to an acoustic output signal are known generally. Such receivers typically include a diaphragm disposed in a receiver housing and separating an interior thereof into a front and back volumes. A motor comprising a coil disposed about an armature having a portion movably located between magnets retained by a yoke is located in the back volume. The electrical input signal applied to the coil excites the movable portion of the armature, which is linked to a movable portion of the diaphragm. Movement of the diaphragm causes the acoustic output signal to emanate from a sound port of the receiver housing.

The receiver diaphragm generally comprises a paddle flexibly coupled to a frame and a suspension element (also referred to herein as a "surround") covering a gap between the paddle and frame to provide an acoustic barrier between the front volume and the back volumes of the housing. The surround is typically made from a urethane or other material that cannot withstand harsh chemical environments or high temperatures such as reflow soldering temperatures without degradation. For example, the urethane material may absorb water, debris or chemicals causing the surround to deteriorate (e.g., detach from the diaphragm, sustain large holes) and high temperatures may cause the surround to deform or melt. Thus, there is a need for more robust receiver diaphragms and particularly surround structures for such diaphragms.

BRIEF DESCRIPTION OF THE DRAWINGS

The disclosure is described in more detail below in connection with the appended drawings and in which like reference numerals represent like components.

DETAILED DESCRIPTION

According to one aspect of the disclosure, a diaphragm for a balanced armature receiver includes a diaphragm body having a paddle. A surround portion made of an elastomer material is fastened to the paddle and extends about a perimeter portion of the paddle. The surround portion is also fastened to at least two non-parallel surfaces of the diaphragm body. In one example, the surround portion is fastened to a first side surface of the paddle and to an outer edge of the paddle. In another example, the surround portion is fastened to a second side surface of the paddle opposite the first side surface. In a further example, the surround portion is fastened to the first side surface adjacent the outer edge and a central portion of the first side surface is devoid of the surround material.

In some embodiments, the diaphragm body includes a frame disposed about the perimeter portion of the paddle and a hinge that flexibly couples the paddle to the frame. In one example, the surround portion is fastened to two non-parallel surfaces of the frame and covers a gap between the frame and the perimeter portion of the paddle. In another example, the surround portion is fastened to two non-parallel surfaces of the frame and only one surface of the paddle. In some embodiments, a portion of the surround portion forms the hinge that interconnects the paddle and the frame. In certain embodiments, the surround portion forms the frame disposed about the perimeter portion of the paddle.

In various embodiments, the surround portion has a non-flat cross-sectional profile having a non-uniform thickness. In other embodiments, the surround portion is adapted to serve as an attachment point for a drive rod and/or serve as an extension of the paddle.

Figure 1:
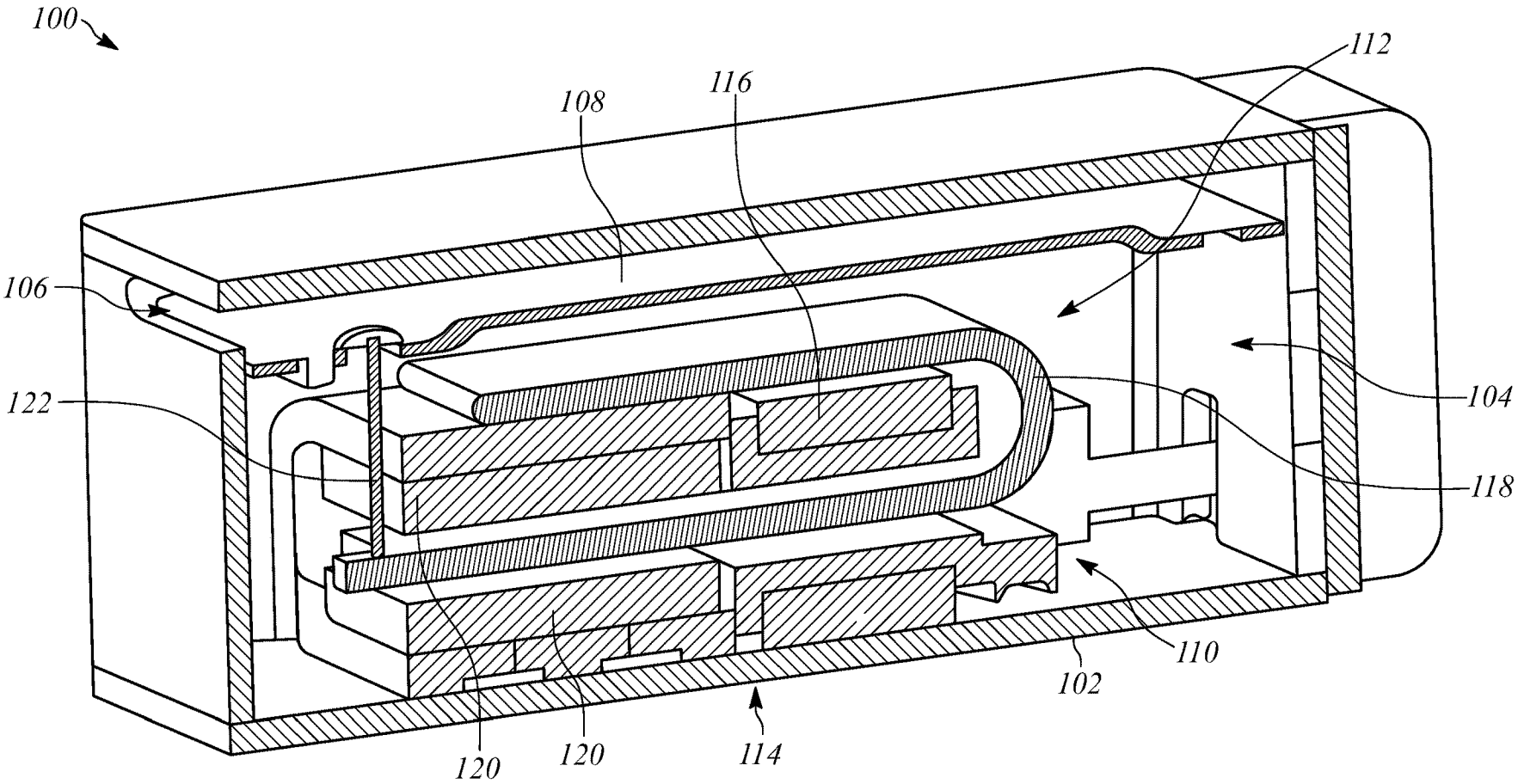
FIG. 1 is a perspective cross-sectional view of an acoustic receiver.

Acoustic receivers are used in various hearing devices such as hearing aids, headsets, hearables, ear buds, etc. In FIG. 1, a cross-section of an acoustic receiver 100 comprises a housing 102 having an interior 104 and a sound port 106. A diaphragm 108 is disposed in the housing and separates the interior into a back volume 110 and a front volume 112 that are acoustically coupled to the sound port. A motor 114 is disposed in the back volume and includes a coil 116, an armature 118, and magnets 120 adjacent the armature. A drive rod 122 interconnects the armature and the diaphragm. A portion of the armature is free to move relative to the magnet in response to an excitation signal applied to the coil.

The movable portion of the armature moves the drive rod which in turn moves the diaphragm, causing the emission of sound from the front volume.

The diaphragm body may comprise a single, unassembled member or be formed as an assembly of separate parts. The diaphragm can be constructed using any suitable technique such as stamping, routing, etching, 3D printing, etc. The diaphragm is mounted in the acoustic receiver (e.g., on a shelf of the housing) by way of gluing, friction fitting, vertical clamping, or any other suitable mechanism. The diaphragm body or at least the paddle is made from a material (e.g., aluminum, copper, carbon fiber, etc.) that provides sufficient stiffness to perform as intended.

Figure 16:
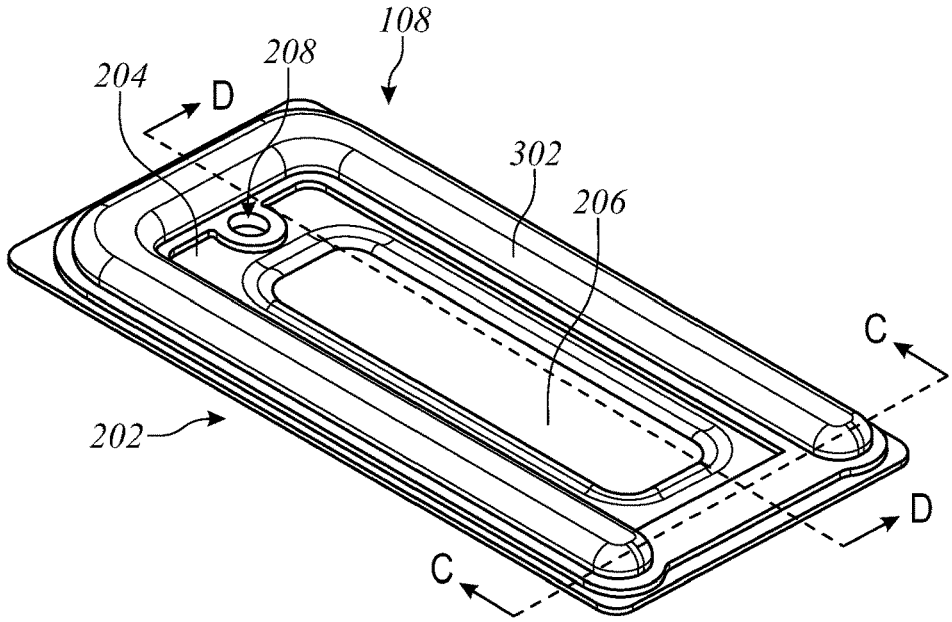
FIG. 16 is perspective view of a diaphragm with an elastomer surround having still another configuration.
Figure 17:
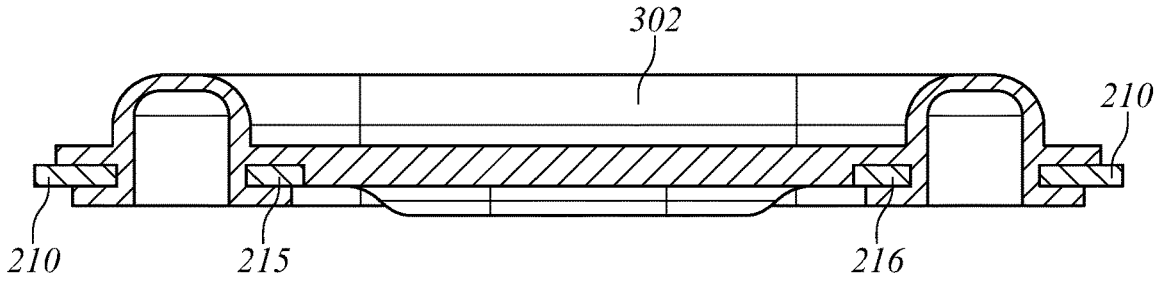
FIG. 17 is a cross-sectional view of the diaphragm along line C-C in FIG. 16.
Figure 18:
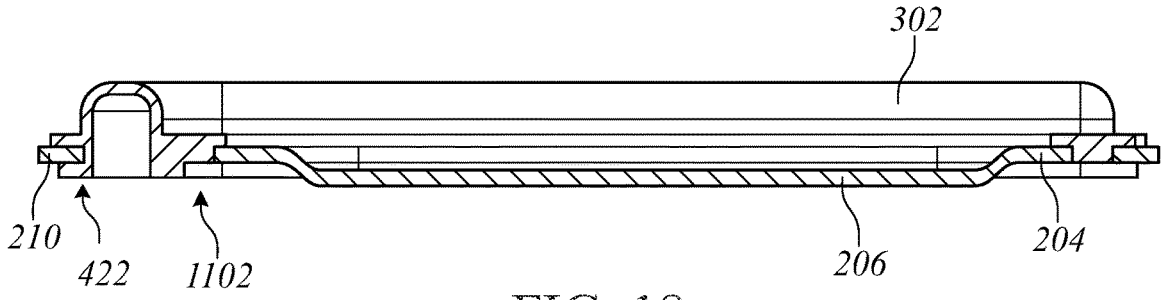
FIG. 18 is a cross-sectional view of the diaphragm along line D-D in FIG. 16.

According to various embodiments, the diaphragm includes a diaphragm body with a movable paddle. In FIGS. 2-4 and 13-28, a diaphragm body 202 including a paddle 204 is shown. A rib 206 can be disposed on the paddle to stiffen the paddle and reduce resonance in the audible range. The rib may be disposed in an upward direction as shown in FIGS. 2-4, 13-15 and 19-26 or in a downward direction as shown in FIGS. 16-18. The rib is generally rectangular in shape, but other shapes (e.g., trapezoidal) are also contemplated (see FIG. 19). In some embodiments, the paddle is flat and does not include any rib.

Figure 19:
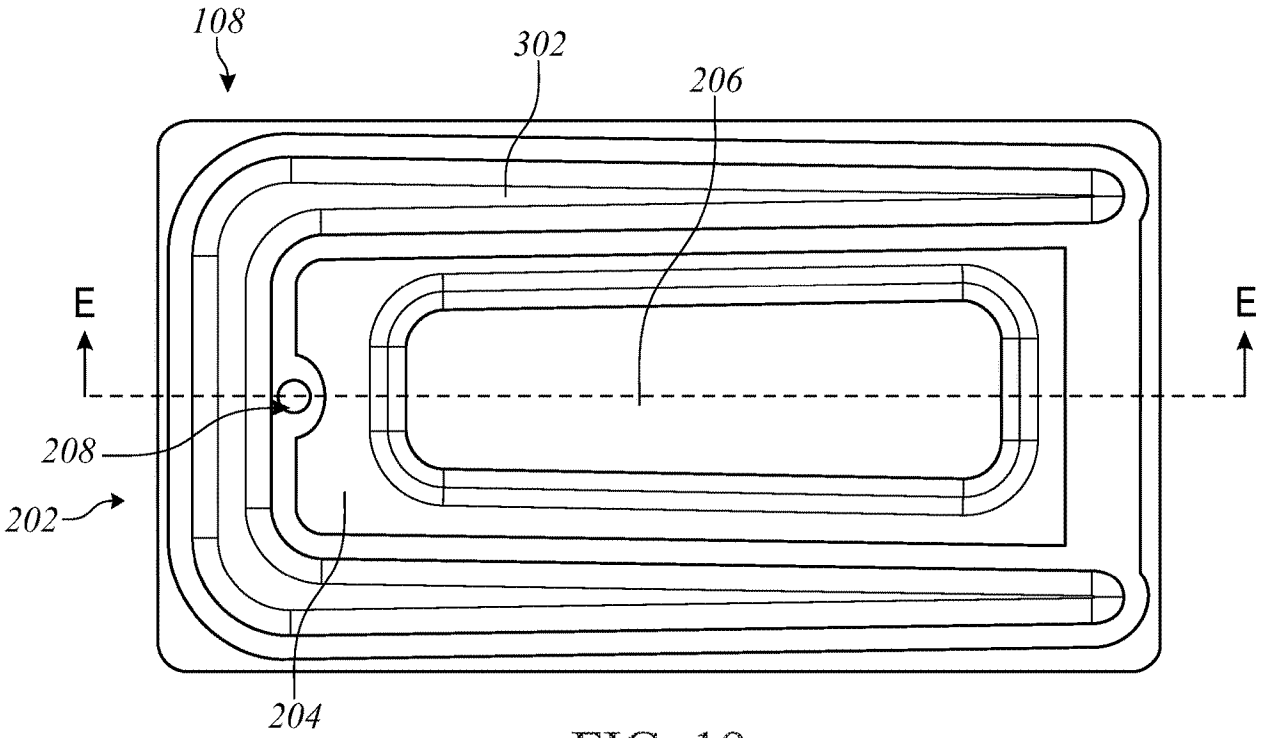
FIG. 19 is a top view of a diaphragm with an elastomer surround having another configuration.
Figure 20:
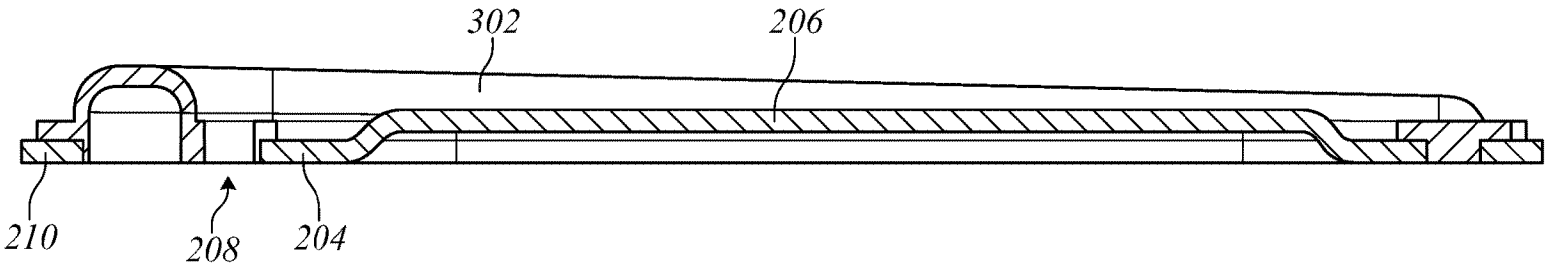
FIG. 20 is a cross-sectional view of the diaphragm along line E-E in FIG. 19.
Figure 21:
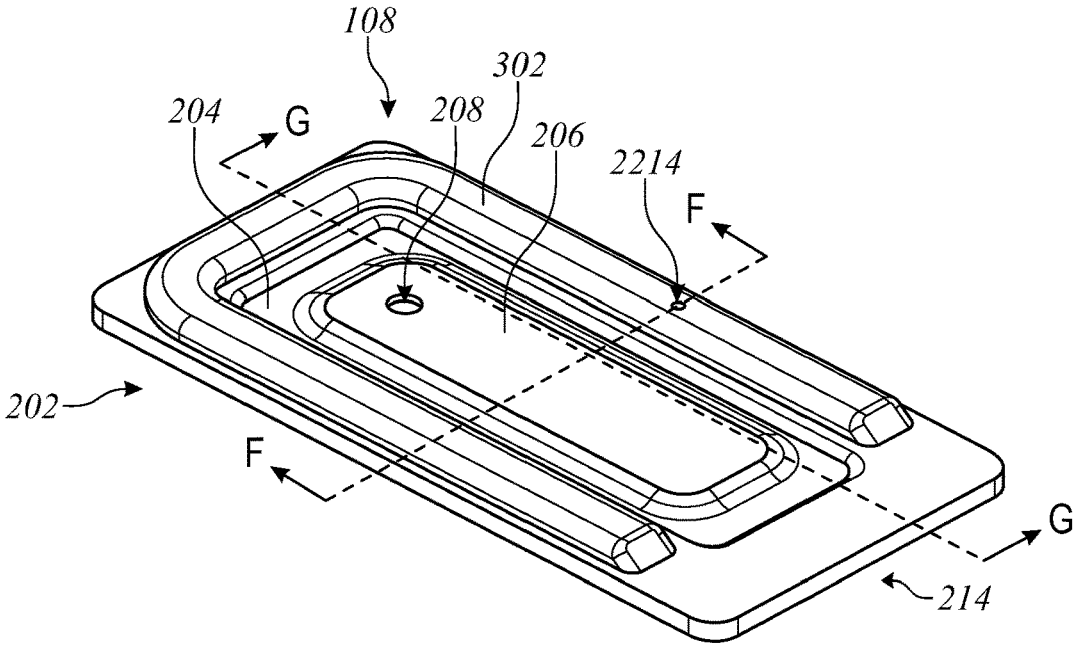
FIG. 21 is a perspective view of a diaphragm with an elastomer surround having still another configuration.
Figure 22:
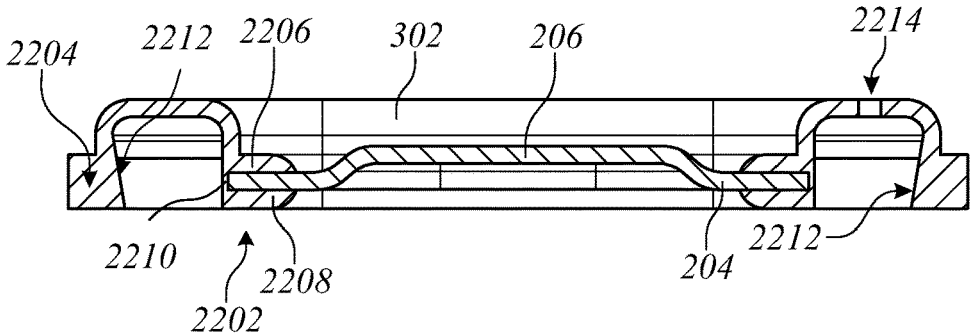
FIG. 22 is a cross-sectional view of the diaphragm along line F-F in FIG. 21.
Figure 23:
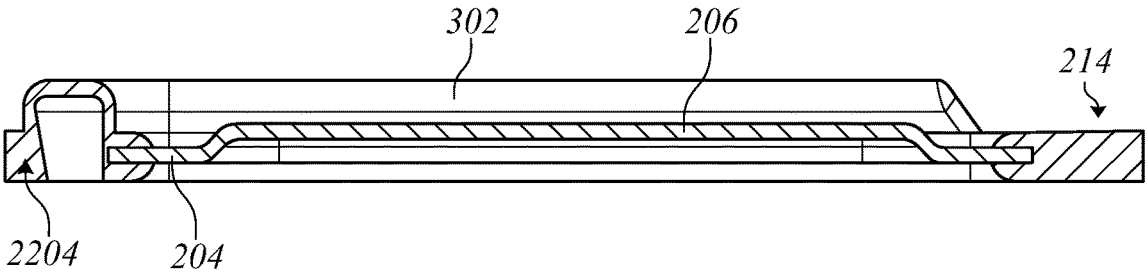
FIG. 23 is a cross-sectional view of the diaphragm along line G-G in FIG. 21.

As shown in FIGS. 2-3, 13, 15-16, 19-21 and 24, the paddle includes an attachment point 208 (e.g., a hole) located near an end of the paddle, where the paddle is to be coupled to the drive rod by glue deposited in the hole. In other implementations, the attachment point may be located anywhere on the paddle. In FIGS. 21-23, the attachment point is located on the rib. Further, the attachment point does not need to protrude through the paddle. For example, in FIG. 15, the attachment point extends only partially into the paddle, but the hole is sufficiently deep to allow for the drive rod to be fastened by glue to the paddle.

In some embodiments, the diaphragm body includes a frame flexibly coupled to the paddle wherein a gap is located between the paddle and frame. In FIGS. 2-4 and 13-20, a frame 210 is disposed about a perimeter portion of the paddle. A generally U-shaped gap 212 separates the perimeter portion of the paddle from the frame. Once coupled to the drive rod, the paddle moves relative to the frame upon deflection of the armature. In certain embodiments, the diaphragm body does not include a frame as shown in FIGS. 21-28.

Figure 2:
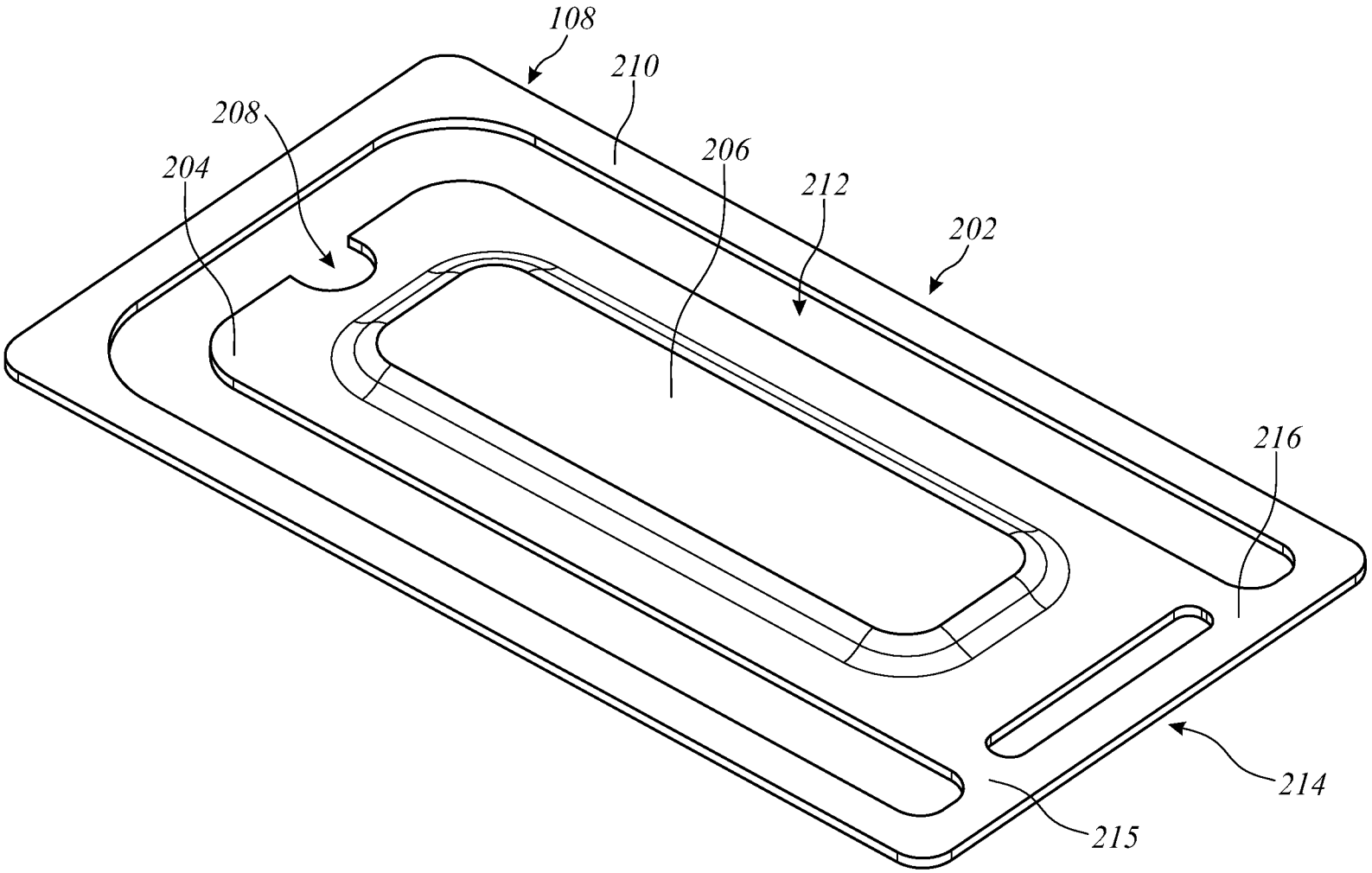
FIG. 2 is a perspective view of a unitary diaphragm body without an elastomer surround covering a gap between the paddle and frame.

In embodiments where the frame exists, the paddle is flexibly coupled to the frame by a hinge. In FIGS. 2-4 and 13-20, a hinge 214 connects the paddle to the frame. As shown in FIG. 2, the hinge may include hinge members 215, 216, which are cantilever hinge members disposed along a single side of the paddle. In other embodiments, the hinge members are torsional hinge members that form torsion hinges disposed on opposite sides of the paddle. In some examples, the frame, the paddle, and the hinge are formed from a single piece of material such as metal, carbon fiber composite or other material having a suitable stiffness.

The diaphragm also comprises a surround disposed about the perimeter of the paddle. In implementations that include a frame, the surround covers the gap between the paddle and the frame. In implementations without a frame, the surround covers a gap between the paddle and a sidewall of the receiver housing. The surround forms an acoustic seal between the front and back volumes of the housing.

The surround is formed of a material selected to comply with desired performance specifications including mechanical compliance, thermal properties, resistance to chemicals (e.g., solvents), among others. The surround is made from an elastomeric material that may comprise silicone, siloxane, siloxane copolymers, grafted siloxane, thermoplastic elastomers (TPE), thermoplastic polyurethanes (TPU), natural and synthetic rubber, polyurethane, ethylene vinyl copolymers (EVAL), n-butylacrylate/PMMA copolymer, ethylene propylene diene copolymers (EPDM), styrene-butadiene copolymers, and other suitable materials.

Siloxane-based surrounds can be use in applications where resistance to high temperatures or harsh chemicals is desired. Additives can be added to improve these characteristics. For example, silicone can withstand temperatures as high as 255° C. or more without significant degradation thereby allowing the acoustic receiver to be reflow soldered onto a host device (e.g., printed circuit board). Surface treatment can be employed to enhance bonding of the silicone material to the diaphragm body. For example, the diaphragm body or bonding agent (e.g., a metal oxide like silicon oxide, a primer, or an adhesive) may be exposed to a promoter, plasma, or other treatment that will enhance the bond between the silicone and the diaphragm body.

In the various diaphragm embodiments described herein, the surround can be fastened to the diaphragm or portion thereof (e.g., the paddle) by insert molding, overmolding, or other encapsulating or assembly process. Where the diaphragm is made of metal, insert molding the elastomer material onto the metal diaphragm creates mechanical elastomeric bonds that are tolerant of high temperatures. Textures or specific surface finishes may be employed in the diaphragm body to further promote mechanical fastening of the surround. In some embodiments, the surround is adapted to serve as the attachment point for the drive rod.

In FIGS. 3-4 and 13-28, a surround portion 302 is fastened directly onto the diaphragm. Accordingly, the surround portion is fastened to at least two non-parallel surfaces of the diaphragm body. As such, the surround portion is fastened to at least two non-parallel surfaces of the frame and at least two non-parallel surfaces of the paddle. The surround portion extends about the perimeter portion of the paddle and covers the gap between the perimeter portion of the paddle and the frame. The surround portion also covers the hinge, as shown in FIGS. 18 and 20. In some embodiments, a portion of the surround portion may form the hinge which has a greater stiffness than other portions of the surround portion.

FIGS. 4, 14, 25 and 26 show the surround portion configured for three-sided attachment to the paddle, the frame or both. In particular, the surround portion is fastened to three surfaces of the paddle to form a U-shaped interface 402 with the paddle such as a slot portion configured to receive an edge of the paddle. The U-shaped interface 402 includes a top portion 404 fastened to a top (or first side) surface 406 of the paddle, a bottom portion 408 fastened to a bottom (or second side) surface 410 of the paddle, and a side portion 412 fastened to a sidewall (or outer edge) 414 of the paddle. The surround portion is also fastened to three surfaces of the frame to form a U-shaped interface 422 with the frame such as a slot portion configured to receive an edge of the frame. The U-shaped interface 422 includes a top portion 424 fastened to a top surface 426 of the frame, a bottom portion 428 fastened to a bottom surface 430 of the frame, and a side portion 432 fastened to a sidewall 434 of the frame.

Figure 3:
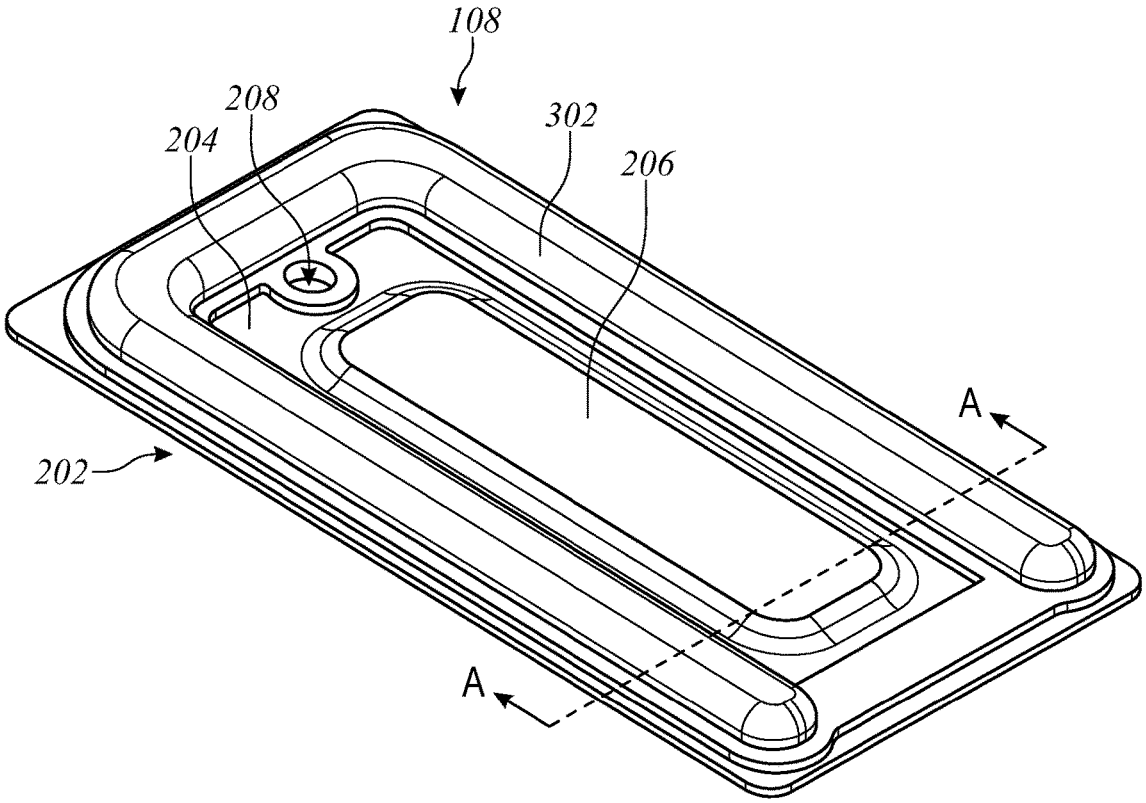
FIG. 3 is a perspective view of a diaphragm with an elastomer surround having one configuration.
Figure 4:
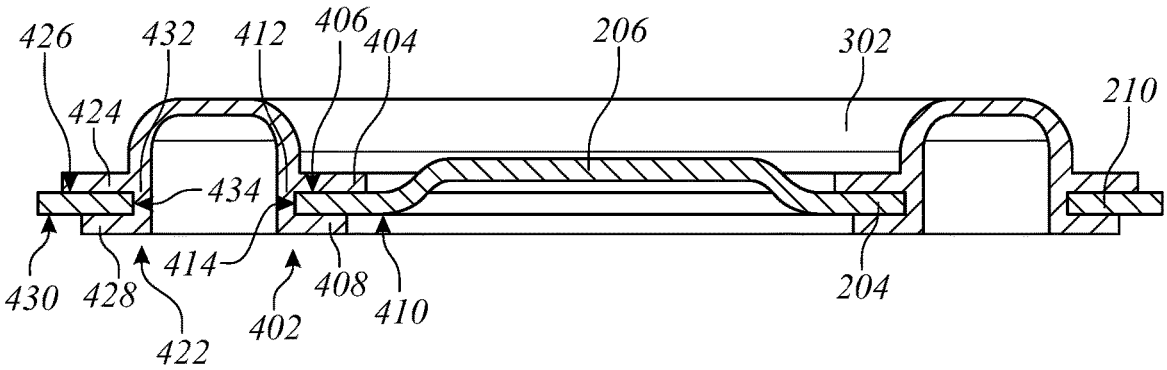
FIG. 4 is a cross-sectional view of the diaphragm along line A-A in FIG. 3.

In FIGS. 3-4, a central portion of the top surface of the paddle is devoid of the surround material. That is, the surround portion does not extend to cover the rib. This may help to reduce the mass of the paddle and improve the high frequency response of the acoustic receiver. In some embodiments shown in FIGS. 13-15, the surround portion extends to cover the entirety of the rib. In other embodiments, the surround portion covers the entire surface of the diaphragm body.

Figure 9:
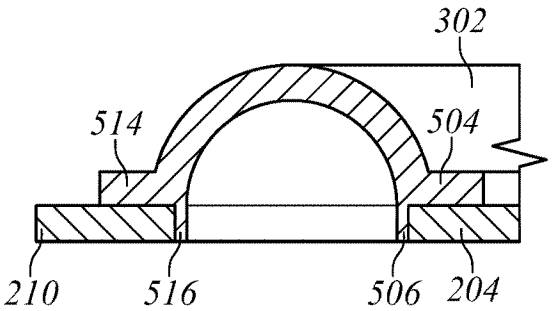

FIGS. 5-12 show variations in the cross-sectional profiles of the surround portion. The cross-sectional profiles are non-flat having various shapes such as tubular (FIGS. 5-7 and 10-12), circular (FIG. 8), or triangular (FIG. 9). Other shapes or geometries are also contemplated. The cross-sectional profiles in FIGS. 5-11 show the surround portion configured for two-sided attachment forming an interface 502 with the paddle and an interface 512 with the frame. In embodiments shown in FIGS. 5 and 7-10, the interface 502 has a top portion 504 fastened to the top surface 406 of the paddle and a top overhang 506 fastened to the sidewall 414 of the paddle. Similarly, the interface 512 has a top portion 514 fastened to the top surface 426 of the frame and a top overhang 516 fastened to the sidewall 434 of the frame.

Figure 6:
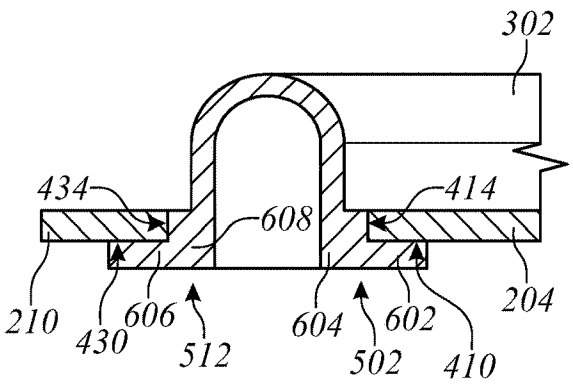

In FIG. 6, the interface 502 has a bottom portion 602 fastened to the bottom surface 410 of the paddle and a bottom overhang 604 fastened to the sidewall 414 of the paddle. Similarly, the interface 512 has a bottom portion 606 fastened to the bottom surface 430 of the frame and a bottom overhang 608 fastened to the sidewall 434 of the frame.

Figure 12:
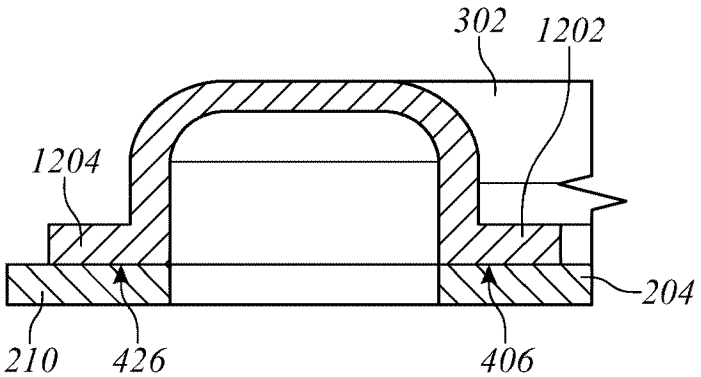
Figure 11:
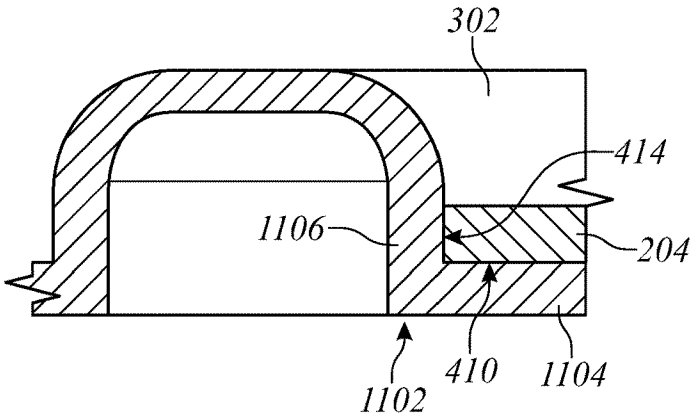
Figure 13:
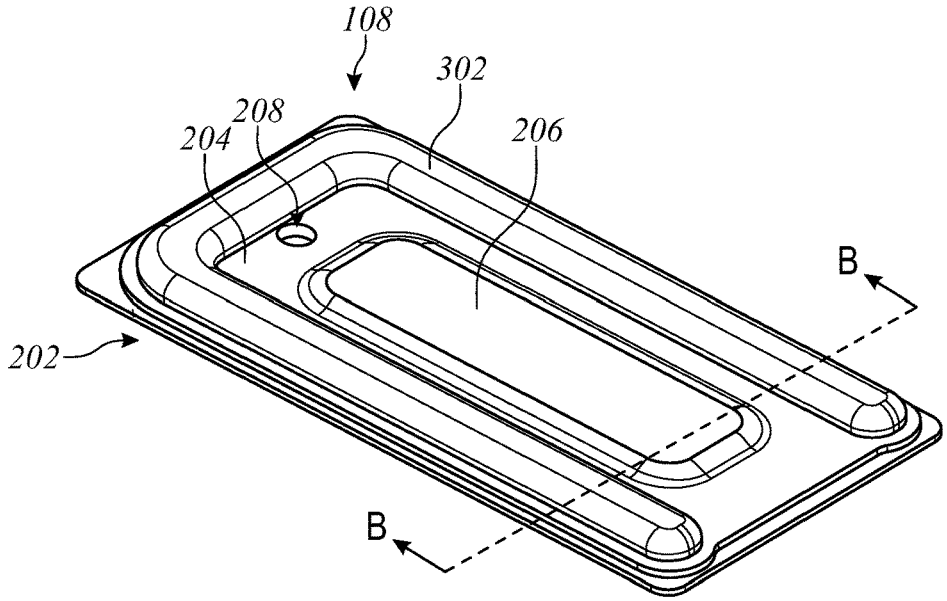
FIG. 13 is perspective view of a diaphragm with an elastomer surround having another configuration.
Figure 14:
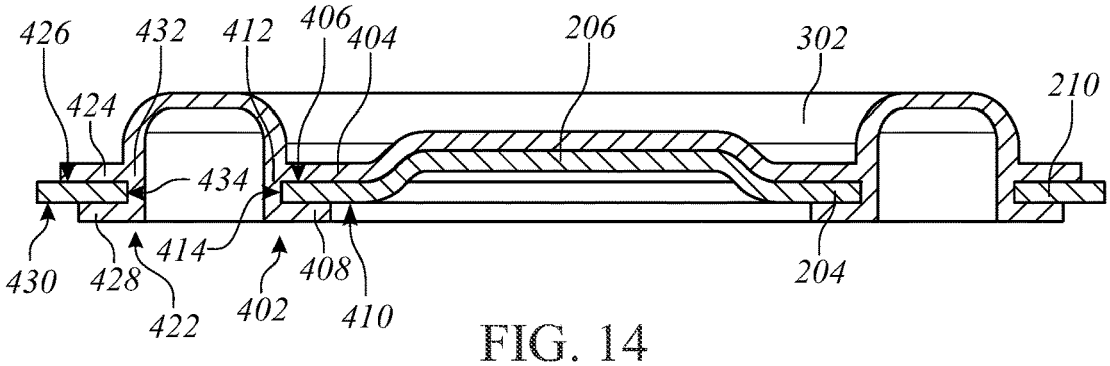
FIG. 14 is a cross-sectional view of the diaphragm along line B-B in FIG. 13.
Figure 15:
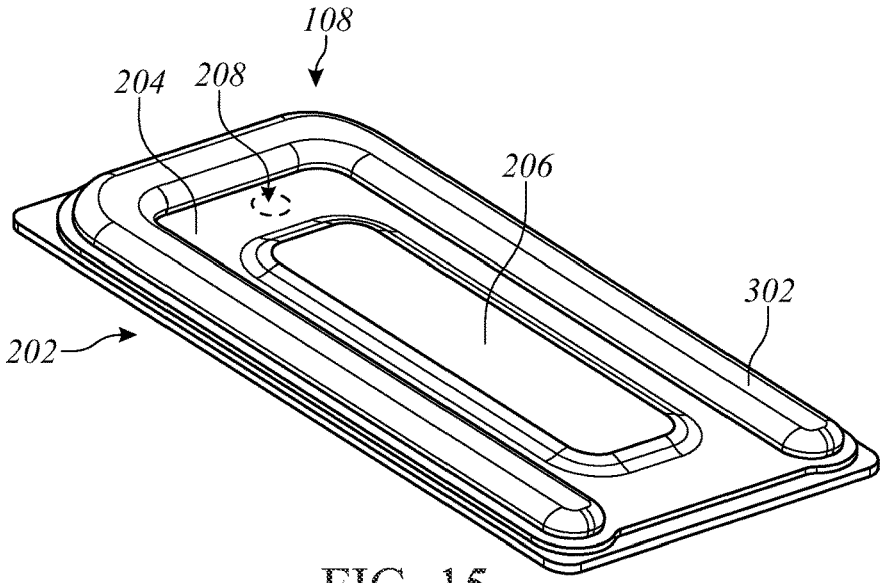
FIG. 15 is perspective view of a diaphragm with an elastomer surround having yet another configuration.

In FIG. 11, the surround portion is fastened to form a L-shaped interface 1102 with the paddle including a bottom portion 1104 fastened to the bottom surface 410 of the paddle and a side portion 1106 fastened to the sidewall 414 of the paddle. In some embodiments, the L-shaped interface 1102 may be inverted to have a top portion fastened to the top surface of the paddle (see FIG. 18). FIG. 12 shows the surround portion fastened to only one surface of the paddle and only one surface of the frame. For example, the surround portion has a portion 1202 fastened to the top surface 406 of paddle and a portion 1204 fastened to the top surface 426 of the frame. In other embodiments, the surround portion may be fastened to adhere to two non-parallel surfaces of the frame and only one surface of the paddle.

Figure 7:
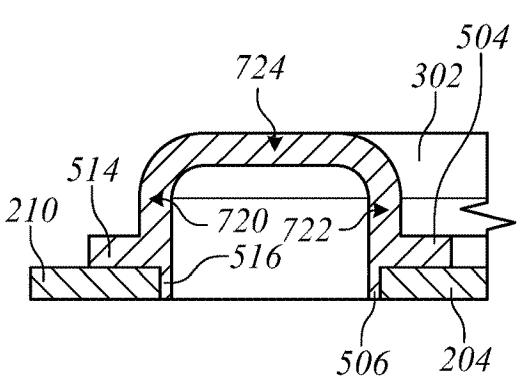
FIGS. 5-12 are partial cross-sectional views of elastomer surrounds having different configurations.
Figure 5:
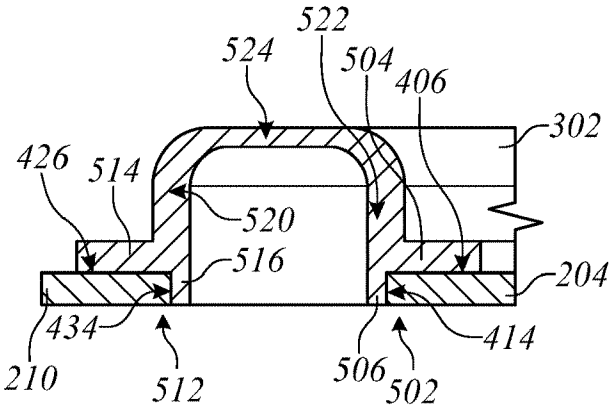
Figure 10:
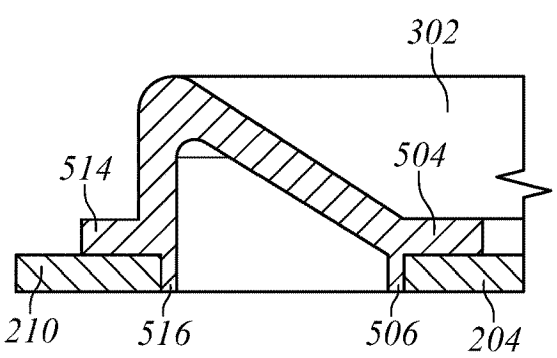
Figure 8:
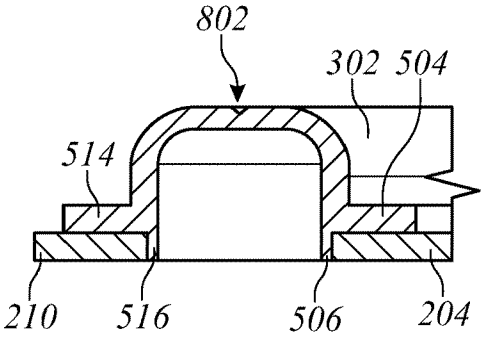

In the various surround embodiments described herein, the surround portion can have a variable cross-sectional thickness. For example, the cross-sectional profile of the surround portion may have a non-uniform thickness as shown in FIG. 5, where side sections 520, 522 are thicker than a top section 524. As an example, the cross-sectional profile of the surround portion may have a uniform thickness as shown in FIG. 7, where side sections 720, 722 have thickness equal to a thickness of the top section 724. In FIG. 8, a notch 802 is present. The notch is an example of local reduction in thickness which helps to compensate for stiffness caused by the bending or stretching of the surround portion during paddle movements.

In FIG. 6 and other embodiments, the interfaces 502, 512 have relatively thick portions that are relatively stiff due to their thickness and therefore the interfaces 502, 512 extend the effective surface area of the paddle.

In some embodiments, an example of which is shown in FIGS. 19-20, the surround portion has a tapered outline with the width and/or height of the surround portion being narrowed/lowered at the hinge. Portions of the surround proximate the hinge can have a smaller height dimension than portions of the surround farther from the hinge since the paddle moves less near the hinge than it does farther away from the hinge. Generally, the width and/or height of the surround portion can either increase or decrease near the hinge as desired.

Figure 24:
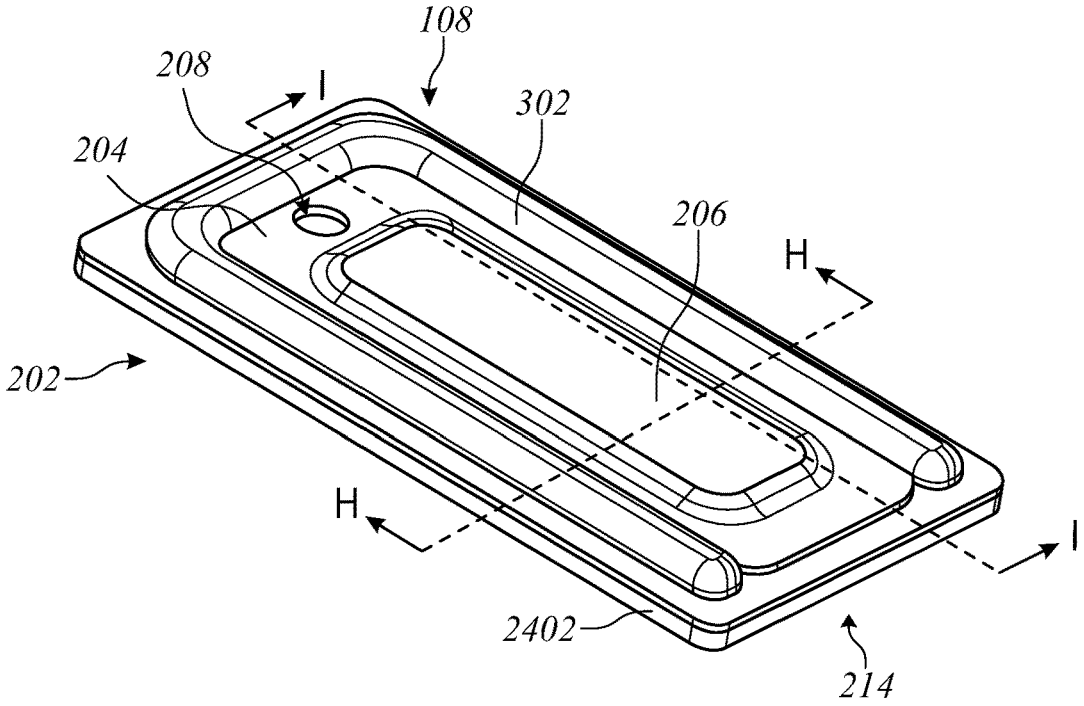
FIG. 24 is a perspective view of a diaphragm with an elastomer surround having yet another configuration.
Figure 25:
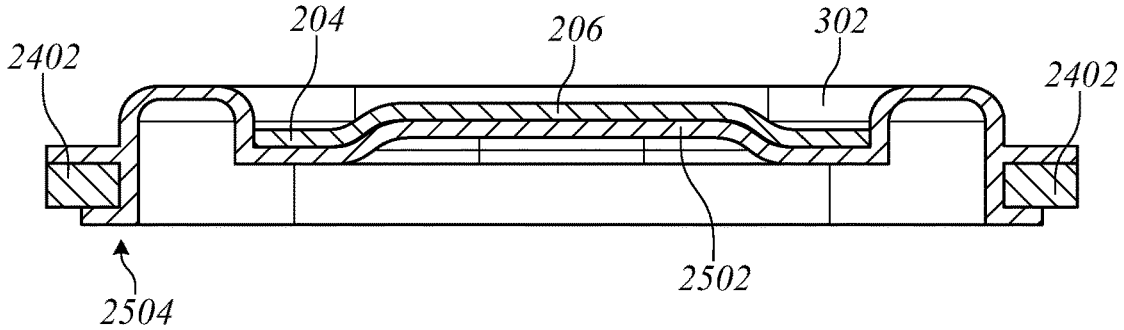
FIG. 25 is a cross-sectional view of the diaphragm along line H-H in FIG. 24.
Figure 26:
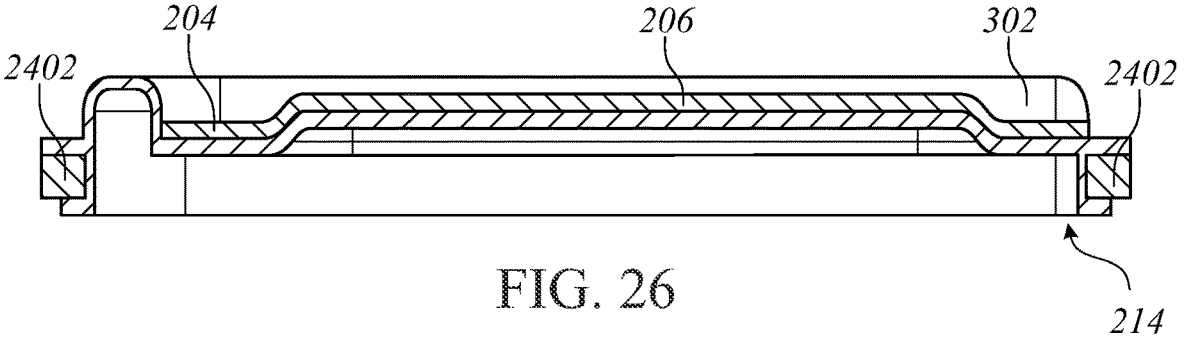
FIG. 26 is a cross-sectional view of the diaphragm along line I-I in FIG. 24.

In embodiments shown in FIGS. 21-28, the diaphragm body does not include a frame and the surround portion is fastened to the paddle along at least two non-parallel surfaces of the paddle. The surround portion forms the hinge 214 and is configured to provide the primary stiffness for the hinge, where the hinge has a greater stiffness than other portions of the surround portion. In FIGS. 21-23, the surround portion forms the frame disposed about the perimeter of the paddle. In FIGS. 24-26, a ring structure 2402 made of a metal or plastic material serves as the frame with the surround portion being coupled to the ring structure.

As shown in FIGS. 21-23, the surround portion includes a paddle section 2202 that interfaces with the paddle and a relatively rigid outer section 2204 that serves as the frame and the hinge. The paddle section 2202 is U-shaped with a top portion 2206 fastened to the top surface of the paddle, a bottom portion 2208 fastened to the bottom surface of the paddle, and a side portion 2210 fastened to the sidewall of the paddle. In these and other embodiments described herein, the top and bottom portions of the paddle section can be molded to have a radius. The thickness of the top, bottom and side portions of the paddle section can be increased to add stiffness and adapted to serve as an extension of the paddle. Optionally, the outer section of the surround portion has angled walls 2212 to allow for bonding larger mounting surface area into the receiver housing in implementations where additional mounting area is advantageous. A small pierce 2214 can be made in the surround portion to create an atmospheric pressure equalization vent between the front volume and the back volume when the diaphragm is assembled mounted with the receiver housing (e.g., via adhesive, friction fit, etc.).

In FIGS. 24-26, the surround portion is coupled to the ring structure serving as the frame. The surround portion is disposed beneath the paddle. As such, the surround portion is shaped to conform to the contour of the paddle by having a rib section 2502 that fastens to the rib on the paddle. The surround portion may be coupled to the ring structure via a U-shaped interface 2504 as shown in FIGS. 25-26.

Figure 28:
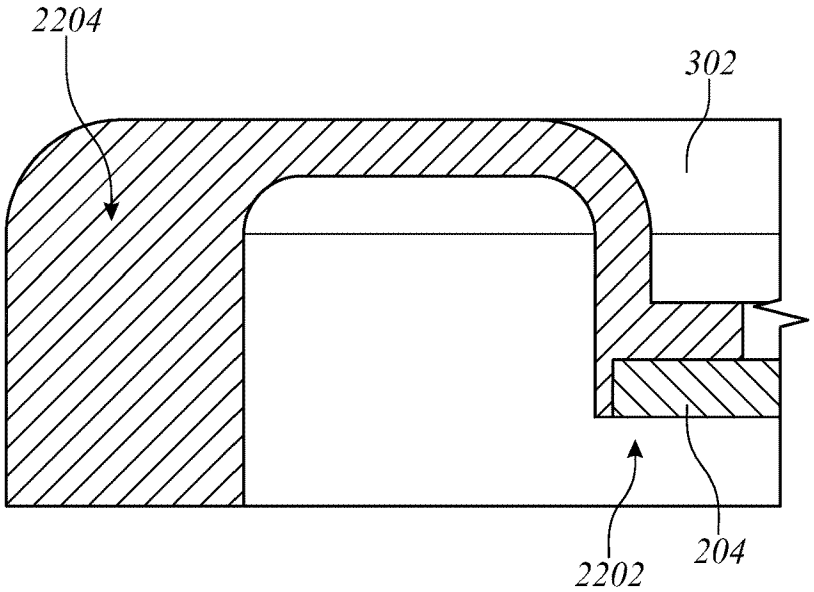
FIGS. 27-28 are partial cross-sectional views of elastomer surrounds having different configurations fastened to a portion of a diaphragm.
Figure 27:
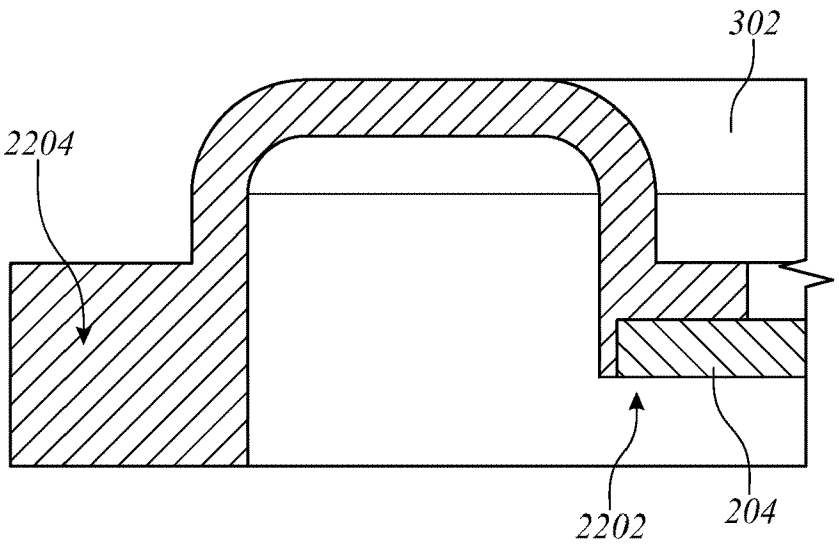

FIGS. 27-28 show variations in the cross-sectional profiles of the surround portion when the surround portion forms the frame. As shown, the surround portion includes a thicker peripheral portion that forms a frame disposed about the perimeter of the paddle. The thicker peripheral portion can interface with and be fastened to a portion of the housing, where the profile portion of the surround couples the paddle and the peripheral portion that forms the frame. The paddle section of the surround portion is fastened to at least two surfaces of the paddle. Other attachment schemes are also contemplated. The outer section forming the frame may have a non-uniform thickness (FIG. 27) or a uniform thickness (FIG. 28) as desired.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. A balanced armature receiver diaphragm comprising:

an unassembled unitary diaphragm body comprising:

a paddle, a frame separated from the paddle by a gap disposed at least partially about a perimeter of the paddle; and a hinge comprising at least two hinge portions separated by a portion of the gap, the hinge interconnecting the frame and the paddle near an end portion of the paddle; and a surround comprising an elastomer material extending across the gap and flexibly interconnecting the paddle and the frame, the surround fastened to at least two non-parallel surfaces of the diaphragm body, wherein a portion of the surround extending across the portion of the gap between the at least two hinge portions has greater stiffness than other portions of the surround.

2. The diaphragm of claim 1, wherein the surround is fastened to a first side surface of the paddle and to an outer edge of the paddle.

3. The diaphragm of claim 2, wherein the surround is also fastened to a second side surface of the paddle opposite the first side surface.

4. The diaphragm of claim 1, wherein the hinge also comprises a portion of the surround extending across the portion of the gap between the at least two hinge portions.

5. The diaphragm of claim 1, wherein the surround is fastened to two non-parallel surfaces of the frame and to only one surface of the paddle.

6. The diaphragm of claim 1, wherein the surround comprises a siloxane material.

7. The diaphragm of any of claim 6 in combination with: a housing having an interior and a sound port;

the diaphragm disposed in the housing and separating the interior into a back volume and a front volume acoustically coupled to the sound port;

a motor disposed in the back volume, the motor comprising a coil, an armature, and a magnet adjacent the armature, wherein a portion of the armature is free to move relative to the magnet in response to an excitation signal applied to the coil; and a drive rod interconnecting the armature and the paddle, wherein the paddle moves relative to the frame upon deflection of the armature.

8. The diaphragm of claim 1 wherein the paddle comprises a drive rod attachment hole, a surface of the paddle adjacent the drive rod attachment hole devoid of the elastomer material.

9. The diaphragm of claim 1 wherein the surround is a molded elastomer material.

10. A balanced armature receiver diaphragm comprising:

a diaphragm body comprising a paddle; and a surround member comprising an elastomer material fastened to the paddle, the surround member comprising a structural frame portion disposed about and separated from a periphery of the paddle by a gap, a flexible surround extending across the gap, and a hinge flexibly coupling the paddle to the structural frame portion at an end portion of the paddle, wherein the structural frame portion, flexible surround, and the hinge consist essentially of the elastomer material.

11. The diaphragm of claim 10, wherein the structural frame portion of the surround member is stiffer than the flexible surround extending across the gap.

12. The diaphragm of claim 10, wherein the portion of the surround member forming the hinge has greater stiffness than other portions of the surround member.

13. The diaphragm of claim 10, wherein the surround member is fastened to a first side surface of the paddle and to an outer edge of the paddle.

14. The diaphragm of claim 13, wherein the surround member is also fastened to a second side surface of the paddle opposite the first side surface.

15. The diaphragm of claim 10, wherein the flexible surround extending across the gap has a non-flat cross-sectional profile.

16. The diaphragm of claim 10, wherein the surround member comprises a siloxane material.

17. The diaphragm of claim 10, wherein a portion of the surround member is adapted to serve as an extension of the paddle.

18. The diaphragm of any of claims 10-17 in combination with: a housing having an interior and a sound port;

the diaphragm disposed in the housing and separating the interior into a back volume and a front volume acoustically coupled to the sound port;

a motor disposed in the back volume, the motor comprising a coil, an armature, and a magnet adjacent the armature, wherein a portion of the armature is free to move relative to the magnet in response to an excitation signal applied to the coil; and a drive rod interconnecting the armature and the paddle, wherein the paddle moves relative to the frame upon deflection of the armature.

19. The diaphragm of claim 10, wherein the paddle comprises a drive rod attachment hole, a surface of the paddle adjacent the drive rod attachment hole devoid of the elastomer material.

20. The diaphragm of claim 10 wherein the surround member is a molded elastomer material.

* * * * *